US008443529B2

(12) United States Patent
Beer et al.

(10) Patent No.: US 8,443,529 B2
(45) Date of Patent: May 21, 2013

(54) TOWED PISTE PROCESSING IMPLEMENT

(75) Inventors: Franz Beer, Elchingen (DE); Martin Nusser, Neu-Ulm (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 309 days.

(21) Appl. No.: 12/924,922

(22) Filed: Oct. 8, 2010

(65) Prior Publication Data

US 2011/0083347 A1 Apr. 14, 2011

(30) Foreign Application Priority Data

Oct. 13, 2009 (DE) ..... 10 2009 049 900

(51) Int. Cl.
*E01H 4/00* (2006.01)

(52) U.S. Cl.
USPC ..... 37/219

(58) Field of Classification Search
USPC ..... 37/219–224, 260, 261, 269, 226, 37/196, 197; 172/72, 112, 117, 123, 310, 172/617, 445.1, 189; 414/569; 404/90, 91
See application file for complete search history.

(56) References Cited

U.S. PATENT DOCUMENTS 4,651,450 A * 3/1987 York et al. ..... 37/197
4,651,451 A * 3/1987 Beeley et al. ..... 37/219
4,726,129 A 2/1988 Haug
5,077,919 A 1/1992 Sinykin
8,230,622 B2 * 7/2012 Dalla Torre et al. ..... 37/219
2003/0051376 A1 3/2003 Lassonde et al.

FOREIGN PATENT DOCUMENTS

EP 2 105 535 A2 9/2009
FR 2 502 020 9/1982

OTHER PUBLICATIONS

Office Action of German Patent Office dated Jun. 15, 2010 (3 pages).
European Patent Office Search Report issued in Application No. 10013531.8 dated Aug. 27, 2012 with English translation of category of cited documents (6 pages).
Submission filed by a third party on Oct. 12, 2012 in corresponding EP Application No. 2314773 (40 pages).

* cited by examiner

*Primary Examiner* — Robert Pezzuto
(74) *Attorney, Agent, or Firm* — Flynn, Thiel, Boutell & Tanis, P.C.

(57) ABSTRACT

A piste processing implement having a finisher arrangement which is composed of an elastically flexible material and which is provided, on its underside facing toward a piste surface, with profilings which form a profile pattern in the piste surface during towing operation. The profilings have differently designed profiling sections distributed over a width of the finisher arrangement, with at least a first profiling section being provided which has a greater width and a smaller depth than the second profiling sections.

16 Claims, 3 Drawing Sheets

TOWED PISTE PROCESSING IMPLEMENT

FIELD OF THE INVENTION

The invention relates to a towed piste processing implement, in particular a snow piste processing implement, having a finisher arrangement which is composed at least in sections of an elastically flexible material and which is provided, on its underside facing toward a piste surface, with profilings which form a profile pattern in the piste surface during towing operation.

Towed piste processing implements of said type are intended for rear-mounted snow cutters on snow piste groomers and also for beach cleaning vehicles, in the case of which a beach surface constitutes a corresponding piste. In the case of beach cleaners, the finisher arrangement serves to smooth and homogenize the sandy beach section cleaned by the beach cleaner.

BACKGROUND OF THE INVENTION

For snow piste groomers, a rear-mounted implement in the form of a rear cutter is generally known. Provided at the rear side on a cutter housing of the rear cutter is a finisher arrangement which serves to smooth and homogenize the snow surface previously processed by the rear cutter. The rear cutter including the finisher arrangement is towed by the snow piste groomer. The finisher arrangement rests on the processed snow surface, and smooths the latter, over the entire width of the rear cutter. On its underside, the finisher arrangement is provided with profilings which extend over the entire width of the finisher arrangement and which imprint a channel-shaped pattern into the snow surface during a corresponding towing process. The finisher arrangement therefore inevitably also compresses the snow surface previously processed by the rear cutter.

SUMMARY OF THE INVENTION

It is an object of the invention to provide a towed piste processing implement of the type mentioned in the introduction which firstly makes it easy to see where the piste surface has already been processed and which secondly permits good utilization of the processed piste surface.

Said object is achieved according to the invention in that the profilings have differently designed profiling sections distributed over a width of the finisher arrangement, with at least a first profiling section being provided which has a greater width and a smaller depth than the second profiling sections. The at least one first profiling section with a greater width serves to provide a visually characteristic pattern for the piste surface smoothed and compressed by the finisher arrangement. It is readily apparent to an observer that said piste surface which is provided with the characteristic profile pattern has already been processed. Furthermore, the relatively wide profiling section in the pattern of the smoothed piste surface dominates the overall appearance of the piste surface, such that irregularities in the rest of the piste surface fade into the background. To the observer, the image of the processed piste surface appears more perfect as a result. Since said first profiling section with a relatively large width has a smaller depth, the imprint generated in the piste surface—during a corresponding towing operation—is lower than the imprints of the second profiling sections. For snow piste surfaces in particular, therefore, the wide sections of the profile pattern which have been generated by corresponding first profiling sections are not to the detriment of skiers or snowboarders traveling on this processed piste surface.

In a refinement of the invention, as viewed in the towing direction of the finisher arrangement, a plurality of rows of profiling sections are provided which are arranged in alignment one behind the other, and so as to be spaced apart, in the towing direction. This refinement is advantageous in particular in the case of a finisher arrangement which is elastically flexible at least in sections. The sliding resistance of the finisher arrangement is reduced as a result of the plurality of mutually spaced-apart rows of profiling sections. The arrangement of the rows of profiling sections in alignment one behind the other ensures that the row of profiling sections following in each case to the rear dips into the imprinted pattern generated by the row of profiling sections in front, and thus further compresses and smooths the already-applied imprinted pattern.

In a further refinement of the invention, the at least one first profiling section has a width which is substantially twice as large as the width of a second profiling section. Said refinement is particularly advantageous for attaining the advantages according to the invention.

In a further refinement of the invention, the at least one first profiling section has, in cross section, a planar base section which is flanked by opening side bevels. This has the result that said at least one first profiling section leaves an imprint which is trapezoidal in cross section, which ensures a characteristic imprinted pattern.

In a further refinement of the invention, the planar base section has width dimensions of between 20 and 30 mm. In a corresponding way, the planar, smooth top side of the profile imprint generated in the piste surface also visually clearly stands out from the profile imprints of the first profiling sections.

In a further refinement of the invention, a depth of each first profiling section is reduced by at least 10% in relation to a depth of each second profiling section. The at least 10% reduction ensures that the processed piste surface which is provided with the profile pattern can be easily traveled over by skiers and snowboarders. The reduction in depth is however advantageously no greater than a maximum of 25% of the depth of each second profiling section in order to prevent the formation of a channel, which could have negative consequences for skiers or snowboarders as they travel over.

In a further refinement of the invention, the finisher arrangement has, in line with the first profiling sections, protuberance regions which project upward from a top side of the finisher arrangement opposite the first profiling sections. This refinement is advantageous in particular if the finisher arrangement is produced, in solid form, from an elastically flexible plastic material. The protuberance regions opposite the wide profiling sections serve to stiffen the elastic plastic material in said regions, and accordingly ensure a reliable smoothing and compressing function even at the level of the wide profiling sections.

BRIEF DESCRIPTION OF THE DRAWINGS

Further advantages and features of the invention will emerge from the claims and from the following description of a preferred exemplary embodiment of the invention, which is illustrated on the basis of the drawings.

DETAILED DESCRIPTION

Figure 1:
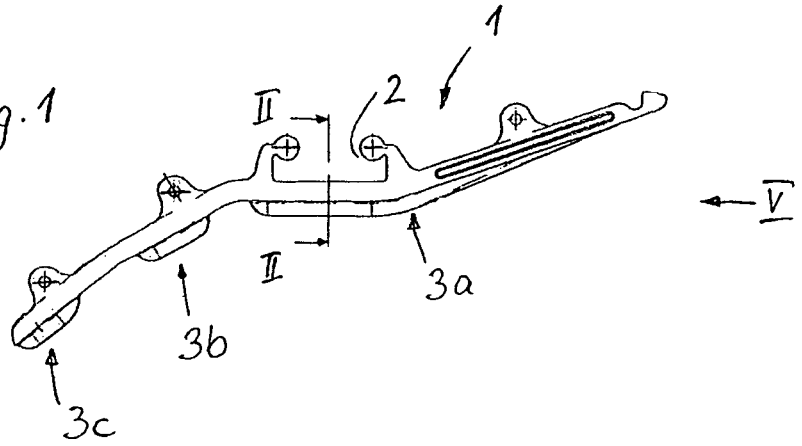
FIG. 1 shows a side view of a finisher arrangement for an embodiment of a piste processing implement according to the invention.
Figure 2:
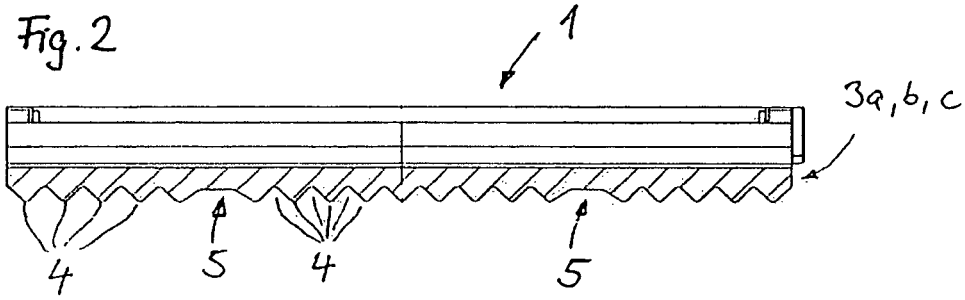
FIG. 2 shows, on an enlarged scale, a section through the finisher arrangement according to FIG. 1 along the section line II-II in FIG. 1, FIG. 3 schematically shows, on a smaller scale, the finisher arrangement according to FIG. 1 in towing operation on a snow piste surface.
Figure 3:
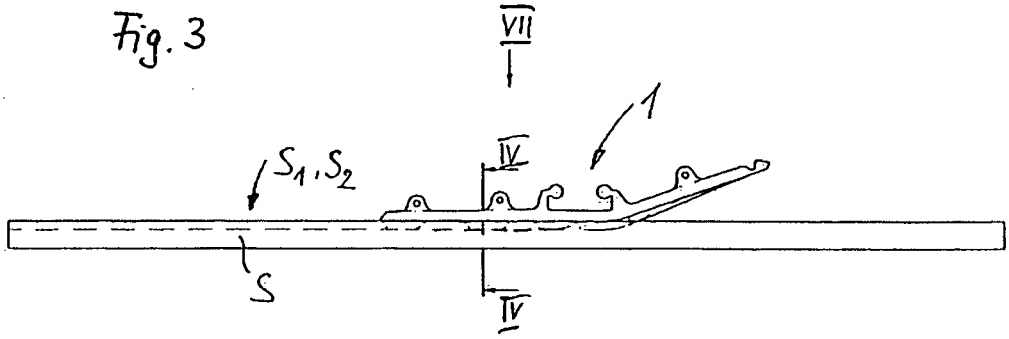
Figure 4:
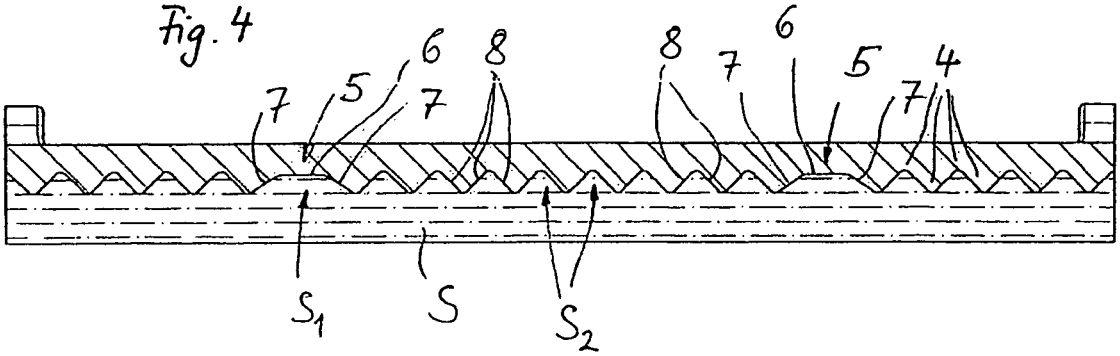
FIG. 4 shows, on an enlarged scale, a section through the arrangement according to FIG. 3 along the section line IV-IV in FIG. 3.
Figure 5:
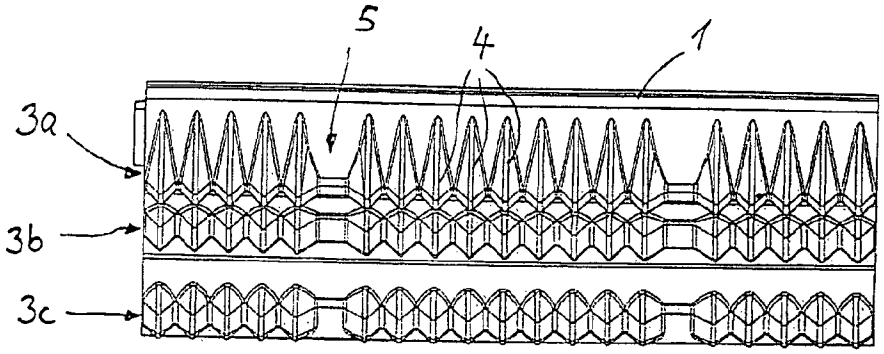
FIG. 5 shows a front view of the finisher arrangement according to FIG. 1 in the direction of the arrow V in FIG. 1.

A finisher arrangement 1 according to FIGS. 1 to 7 serves to compress and smooth snow surfaces S which have previously been processed by means of a rear cutter device of a piste groomer. In a way which is not illustrated, the finisher arrangement is arranged at the rear side on the rear cutter and is towed together with the rear cutter by the piste groomer. The rear cutter is held on a vehicle rear end of the piste groomer by means of a rear-end attachment support. A piste groomer having a rear cutter of said type and an associated finisher arrangement serves for configuring and for maintaining ski and snowboard pistes in ski resorts. The finisher arrangement extends over the entire width of a corresponding rear cutter and laterally beyond the rear cutter. The finisher arrangement 1 is composed of a plastic material which is stable but elastically flexible at least in sections. In the region of its upper side, the finisher arrangement has a receiving groove for receiving corresponding cross members which can exert pressure forces on the finisher arrangement 1 from above in order to press the finisher arrangement 1 against the snow surface. The cross members are assigned to a cutter frame of the rear cutter and may be acted on hydraulically with pressure in order to generate the desired pressure on the finisher arrangement 1.

To be able to press a characteristic imprint profile into the processed snow surface during a corresponding towing process, the finisher arrangement 1 is provided, on its underside, with a total of three rows of profiling sections 3*a*, 3*b*, 3*c* which are arranged one behind the other at intervals. It can be seen from FIG. 5 that each row 3*a* to 3*c* has two first profiling sections 5 spaced apart laterally from one another and also a multiplicity of second profiling sections 4 which are of identical design to one another and which are arranged between the two first profiling sections 5. The profiling sections 4 and 5 of each row 3*a* to 3*c* are aligned with one another in the towing direction such that the row 3*b*, 3*c* situated in each case to the rear in the towing direction dips into the profile imprinted in the snow surface S by the row 3*a*, 3*b* in front.

All the profiling sections 4 are of identical design to one another. As can be seen on the basis of FIGS. 2 and 4, the profiling sections 4 have a wedge-like shape, in each case with the cross section of an isosceles triangle. In contrast, the first profiling sections 5 have a trapezoidal cross section. For this purpose, said first profiling sections 5—as viewed in cross section—are provided with a planar base section 6 which, in the case of a horizontal snow surface, is likewise aligned horizontally during towing operation. Said planar base section 6 is adjoined at both sides by outwardly oblique wall sections 7 which flank each base section 6 on opposite sides. Said oblique wall sections 7 merge directly into the profiling sections 4 which are of triangular cross section and which each have, in cross section, limb sections 8 inclined at 45° with respect to the horizontal. The oblique wall sections 7 are aligned at a smaller angle than this relative to the horizontal. The first profiling sections 5 form profile imprints $S_1$ in the snow surface S. The second profiling sections 4 form profile imprints $S_2$ in the smoothed and compressed snow surface S.

The width of a first profiling section 5—as viewed transversely with respect to the towing direction—is twice as large as the width of a second profiling section 4. In contrast, a depth of each profiling section 5 is smaller than the depth of a groove between two adjacent profiling sections of triangular cross section. In this way, each profile imprint $S_1$ in the snow surface S also has a smaller height than each profile imprint $S_2$ formed by the profiling sections 4 in the snow surface S.

Figure 6:
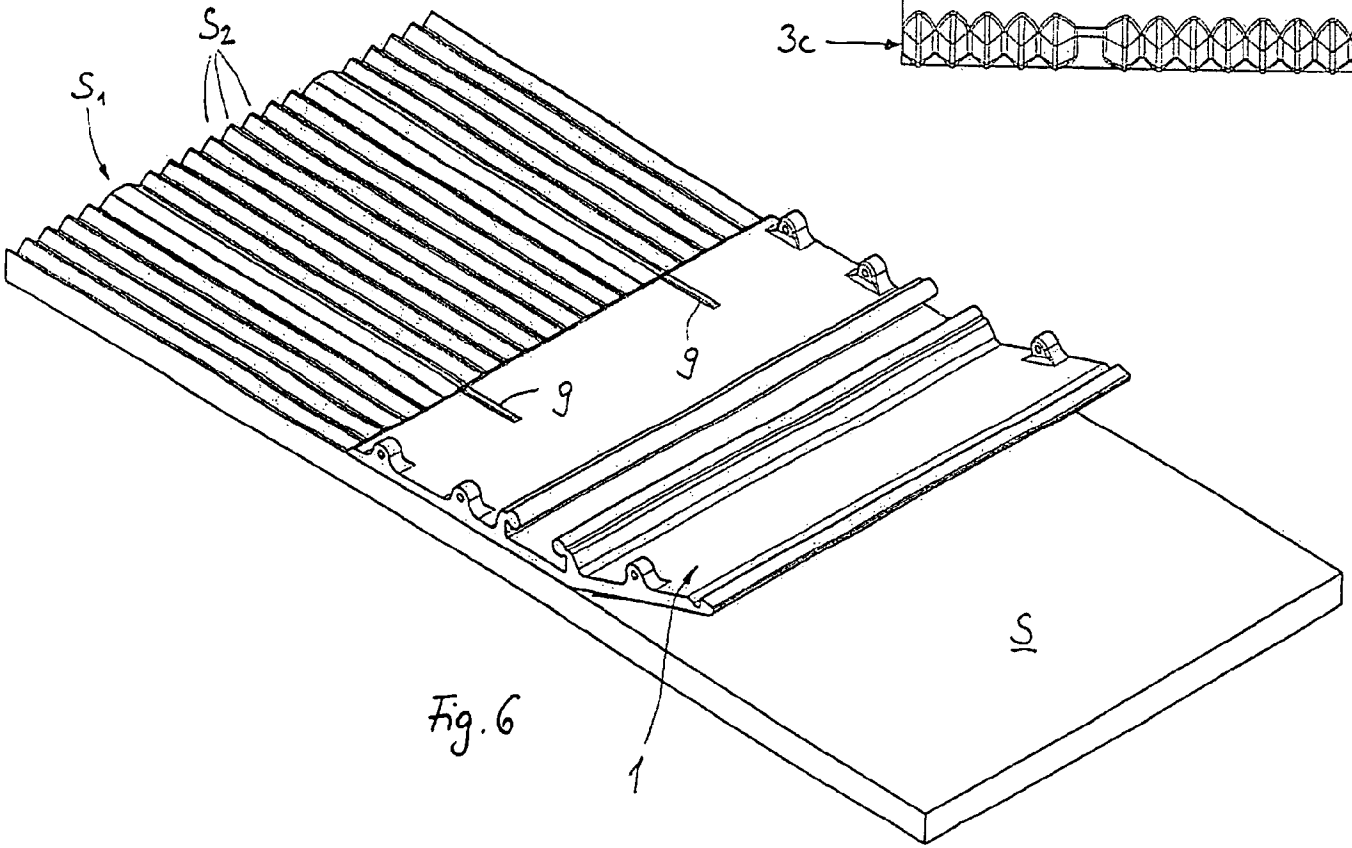
FIG. 6 shows the finisher arrangement on the snow surface according to FIG. 3, but in a perspective illustration.
Figure 7:
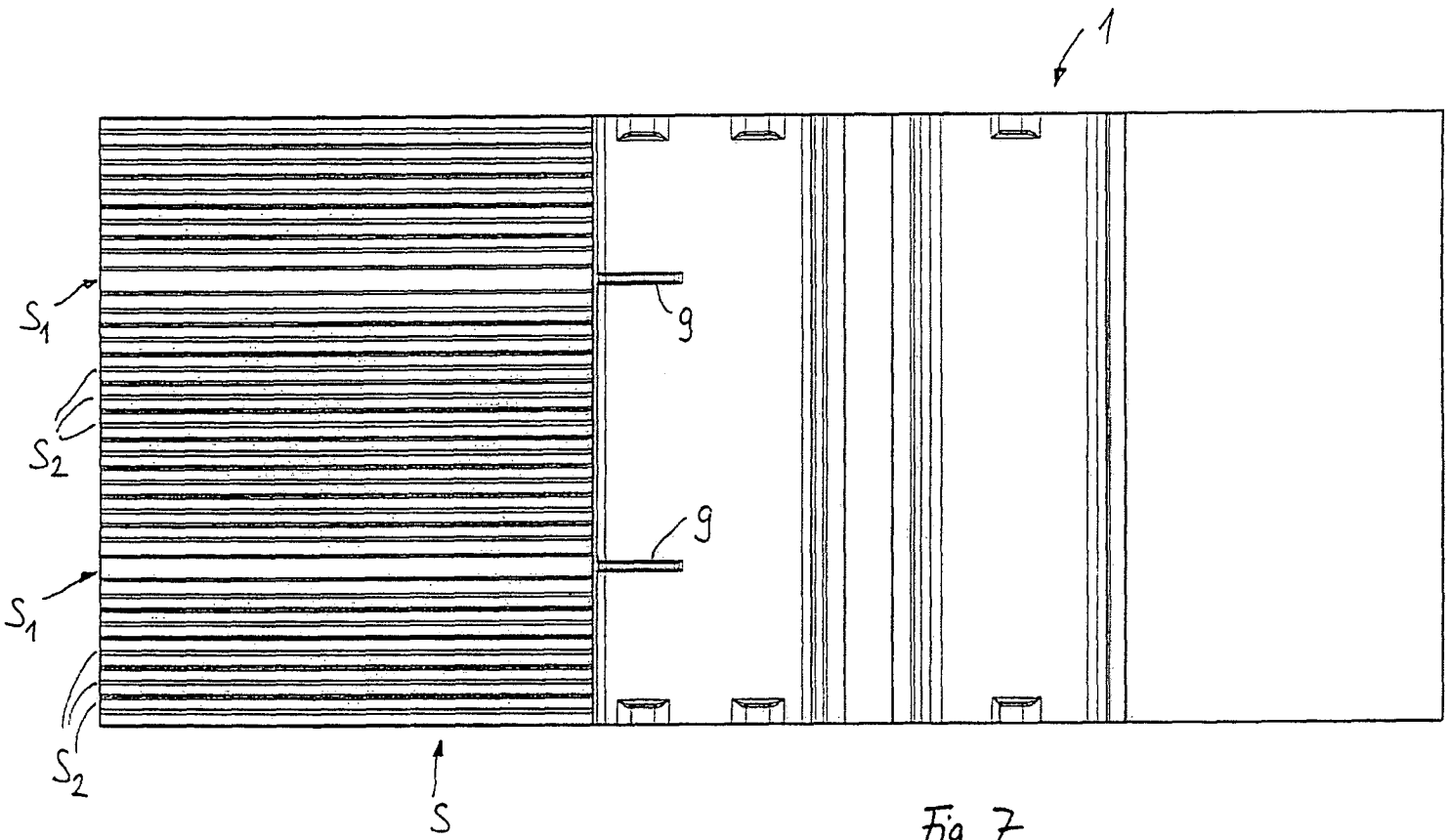
FIG. 7 shows the finisher arrangement according to FIG. 3 being towed on the snow surface, in a plan view in the direction of the arrow VII in FIG. 3.

As can be seen from FIGS. 6 and 7, the top side of the finisher arrangement 1 is provided, in line with the two wide profiling sections 5, with web-like protuberances 9 which extend in the towing direction and which are integrally formed out of the top side of the finisher arrangement 1. Said protuberances 9 serve to stiffen the finisher arrangement 1 in the end-side region of the finisher arrangement 1, as can be seen from FIGS. 6 and 7.

The invention claimed is:

1. A towed piste processing implement comprising a finisher arrangement which is composed at least in sections of an elastically flexible material and which is provided, on an underside thereof facing toward a piste surface, with profilings which form a profile pattern in the piste surface during a towing operation, wherein the profilings have differently designed profiling sections distributed over a width of the finisher arrangement in a direction perpendicular to a towing direction of the finisher arrangement, with at least one first profiling section being provided which has a greater width and a smaller depth than at least one second profiling section, and wherein the profilings are aligned in the towing direction to provide the profile pattern on the piste surface behind the piste processing implement after the finisher arrangement has passed over the piste surface.

2. The piste processing implement according to claim 1, wherein, as viewed in the towing direction of the finisher arrangement, a plurality of rows of profiling sections are provided which are arranged in alignment one behind the other, and so as to be spaced apart in the towing direction.

3. The piste processing implement according to claim 1, wherein the at least one first profiling section has a width which is substantially twice as large as a width of the at least one second profiling section.

4. The piste processing implement according to claim 1, wherein the at least one first profiling section comprises, in cross section, a planar base section which is flanked by opening side bevels.

5. The piste processing implement according to claim 4, wherein the planar base section has width dimensions of between 20 and 30 mm.

6. The piste processing implement according to claim 1, wherein a depth of each of the at least one first profiling section is reduced by at least 10% in relation to a depth of each of the at least one second profiling section.

7. The piste processing implement according to claim 1, wherein the finisher arrangement has, in line with the at least one first profiling section, protuberance regions which project upward from a top side of the finisher arrangement opposite the at least one first profiling section.

8. A towed piste processing implement comprising:

a finisher arrangement including an elastically flexible material provided on an underside thereof for facing toward a piste surface, the finisher arrangement including a plurality of first projections in a first area and a plurality of second projections in a second area, the first area and the second area being located in a line along a width of the finisher arrangement perpendicular to a towing direction of the finisher arrangement, the plurality of first projections and the plurality of second projections forming a profile pattern in the piste surface behind the piste processing implement after the finisher arrangement has passed over the piste surface during a towing operation in the towing direction;

the plurality of first projections in the first area forming a first profile recess between each adjacent pair of the plurality of first projections;

the plurality of second projections in the second area forming a second profile recess between each adjacent pair of the plurality of second projections;

the first profile recess having a greater width and a smaller depth than the second profile recess; and the profile pattern in the piste surface substantially corresponding to a shape of the plurality of first projections, each first profile recess, the plurality of second projections and each second profile recess.

9. The piste processing implement according to claim 8, wherein the finisher arrangement includes a plurality of rows of the first projections and a plurality of rows of the second projections aligned and spaced apart in the towing direction.

10. The piste processing implement according to claim 8, wherein the second area has a width which is substantially twice as large as a width of the first area along the line perpendicular to the towing direction of the finisher arrangement.

11. The piste processing implement according to claim 8, wherein the first recess comprises, in cross section, a planar base section which is flanked by opening side bevels.

12. The piste processing implement according to claim 11, wherein the planar base section has width dimensions of between 20 and 30 mm.

13. The piste processing implement according to claim 8, wherein a depth of the first profile recess is at least 10% less than a depth of the second profile recess.

14. The piste processing implement according to claim 8, wherein the finisher arrangement has, in line with the first area, protuberance regions which project upward from a top side of the finisher arrangement opposite the plurality of first projections.

15. The piste processing implement according to claim 8, wherein first apex points of each of the plurality of first projections and second apex points of each of the plurality of second projections are parallel.

16. The piste processing implement according to claim 15, wherein the first profile recess and the second profile recess have different cross-sectional profiles.

* * * * *